US005511386A

United States Patent [19]

Russ et al.

[11] Patent Number: 5,511,386

[45] Date of Patent: Apr. 30, 1996

[54] ADJUSTABLE PITCH CONDENSATE DRAIN WITH INTEGRAL OVERFLOW

[75] Inventors: Jeffrey S. Russ, Creve Couer, Mo.; James M. McKallip, Lafayette, N.Y.

[73] Assignee: Carrier Corporation, Syracuse, N.Y.

[21] Appl. No.: 344,139

[22] Filed: Nov. 23, 1994

[51] Int. Cl.[6] ..... F25D 21/14

[52] U.S. Cl. ..... 62/285; 62/288; 62/297; 62/298

[58] Field of Search ..... 62/285, 286, 287, 62/288, 289, 291, 297, 298, DIG. 16

[56] References Cited

U.S. PATENT DOCUMENTS

| | | | |
|---|---|---|---|
| 2,152,691 | 4/1939 | Harbers | 62/286 |
| 3,352,126 | 11/1967 | Beshekas | 62/286 |

*Primary Examiner*—John M. Sollecito

[57] ABSTRACT

A fan coil condensate drain pan is made to be field adjustable to be pitched either to the fight side or to the left side when the fan coil unit is installed. This permits the drain pan to be self-draining and to be connected to a convenient field drain with a minimum of piping. The drain pan employs an elongated trough with an open upper side, and with left and right end caps. There are left and fight drain nipples that project through the respective end caps. The cabinet for the fan coil unit has left and right mounting brackets to which the left and right end caps are attached. The brackets have vertically elongated adjustment slots, and sheet metal screws or other suitable fasteners in these slots hold the end caps in place. The pitch can be selected on installation by loosening the screws on one side and lowering the end cap at that side. The drain nipple on the other side can be left open to serve as an overflow outlet.

5 Claims, 5 Drawing Sheets

ADJUSTABLE PITCH CONDENSATE DRAIN WITH INTEGRAL OVERFLOW

BACKGROUND OF THE INVENTION

This invention relates to heating and air conditioning systems, and is more particularly directed towards fan coil units for heat pump and/or air conditioning systems having separate fan coil type heat exchangers.

The invention is more specifically concerned with an improved condensate drain pan employed with the evaporator fan coil unit of an air conditioner or heat pump. The improvement of this invention facilitates field installation by permitting field-adjustment of the drain pan to accommodate drainage of condensate.

In air conditioning units, condensate which occurs in the evaporator coil must be drained away and dispensed with. Current indoor air quality standards require that air handling unit condensate pans shall be designed for self-drainage to preclude build up of microbial slime. This requires that the condensate drain pan be pitched to one side or the other, i.e., towards the left or right side of the fan coil unit. The condensate then should pass through drain piping into a field drain.

A problem arises in factory pre-pitched drain pans. By pitching the drain pans to one side, the field drain pan is dedicated to a specific side of the fan coil unit. This limits some applications because of a lack of access to a drain, or because excess piping may be required simply to carry the condensate discharge around the fan coil unit to the field drain. This is further complicated by the fact that the installer does not know until installation which end of the unit is closer to the field drain. This makes it impractical even to provide separate left- and fight-drain fan coil units.

OBJECTS AND SUMMARY OF THE INVENTION

It is an object of this invention to provide an improved condensate drain pan that avoids the problems of the prior art.

It is another object of this invention to provide a condensate drain pan for a fan coil unit which can be selectively pitched to right or left for self-drainage.

It is a more specific object to provide a field-adjustable condensate drain pan which can be pitched to one side or the other independently of the associated evaporator coil, simply by adjusting a few screws or similar fasteners.

According to one embodiment of the invention, an adjustable condensate drain pan is provided for the fan coil unit of an air conditioning and/or heat pump unit. The condensate drain pan can be located in the indoor fan coil unit or in the outdoor fan coil unit, or both. The disclosed design is especially useful in a indoor fan coil unit installation.

In the fan coil unit, a heat exchanger coil, to wit, the coil that serves as an evaporator, condenses moisture from the air as it absorbs heat from the air passing over the coil. The condensate pan is disposed at a lower end of the heat exchanger coil to receive the condensate. The drain pan is preferably an elongated trough with an open top, and with left and right end caps closing off the ends of the trough. Left and right drain ripples project through the respective end caps. The cabinet of the fan coil unit has left and fight mounting brackets, and the left and right end caps of the condensate drain pan are fastened to these brackets. Each of the brackets has a vertically elongated drain slot through which the associated drain nipple projects. This slot permits vertical play or adjustment between upper and lower limits. There is at least one vertically elongated fastener slot, and preferably a pair of slots, one on either side of the drain slot. Sheet metal screws or other suitable fasteners extend through these fastener slots into the end caps to fasten the same in place. The screws on one side can be loosened to permit the drain pan to be lowered on that side, and then the screws can be tightened with the associated end cap and drain nipple in the lowered position. The lower nipple serves as a drain connection and the piping connects this nipple to a field drain. The other, higher tipple then serves as an overflow drain.

Preferably, the trough is extruded plastic resin and the end caps and drain nipples are molded plastic. The plastic construction avoids corrosion from contact with the condensate.

The fan coils can be shipped from the factory or dealer with the drain pan level, and the installer can drop down the appropriate end by way of the sheet metal screws and fastener slots. This involves adjusting only a single pair of screws.

This construction also permits the evaporator fan coil unit to be installed level, which would not be the case if the condensate drain pan were fixed in a level relation to the evaporator coil.

The above and many other objects, features, and advantages of this invention will become apparent from the ensuing description of a preferred embodiment, which should be read in connection with the accompanying Drawing.

DETAILED DESCRIPTION OF THE PREFERRED EMBODIMENT

Figure 1:
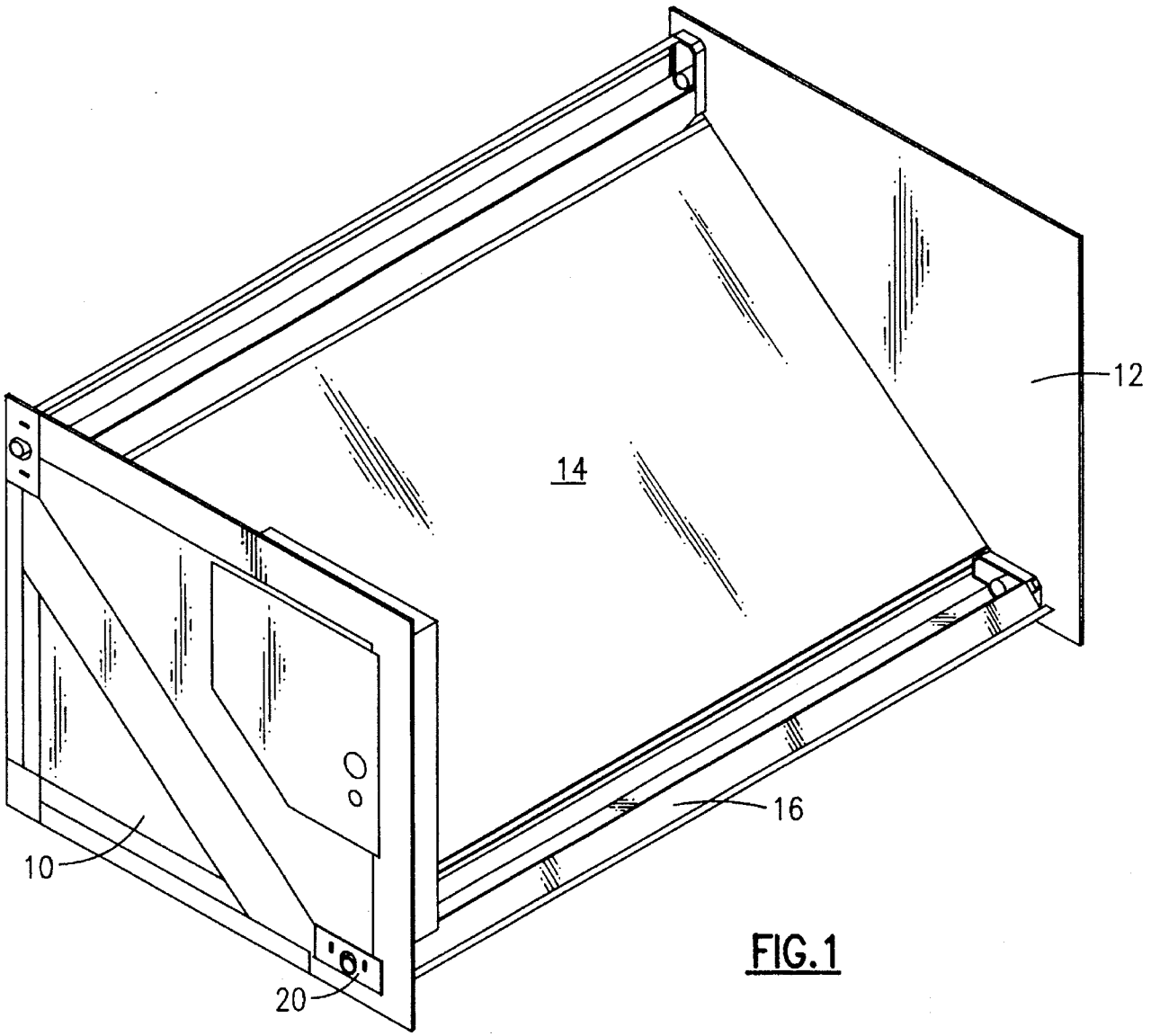
FIG. 1 is a perspective view of a fan coil unit employing an adjustable condensate drain pan according to one embodiment of this invention.
Figure 2:
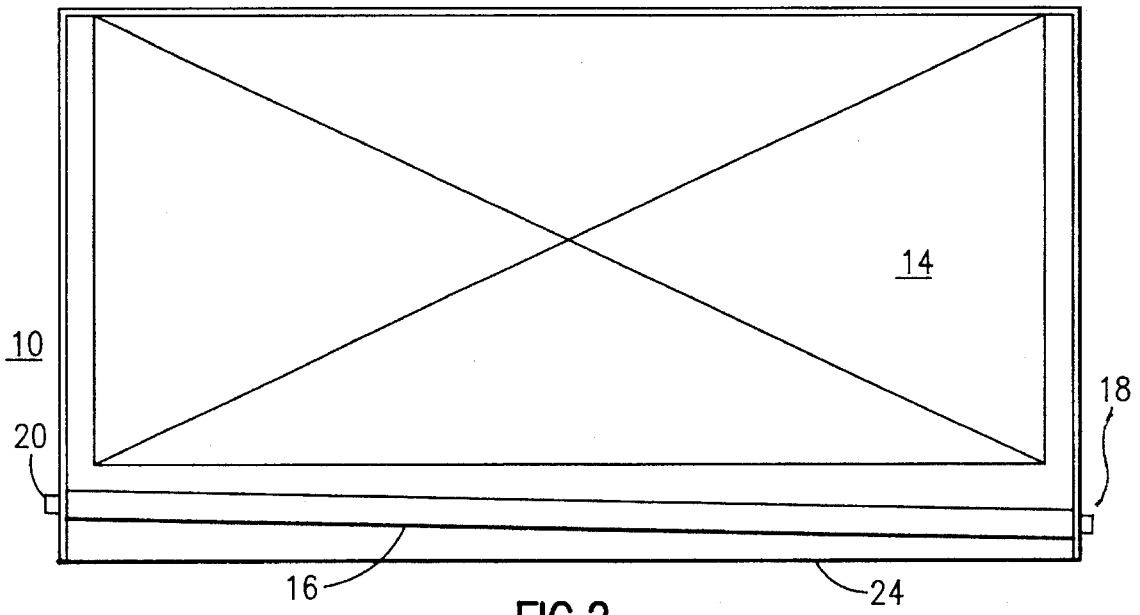
FIGS. 2 and 3 are schematic front elevations of the fan coil unit of FIG. 1, showing the drain pan adjusted for fight-side discharge and left-side discharge, respectively.
Figure 3:
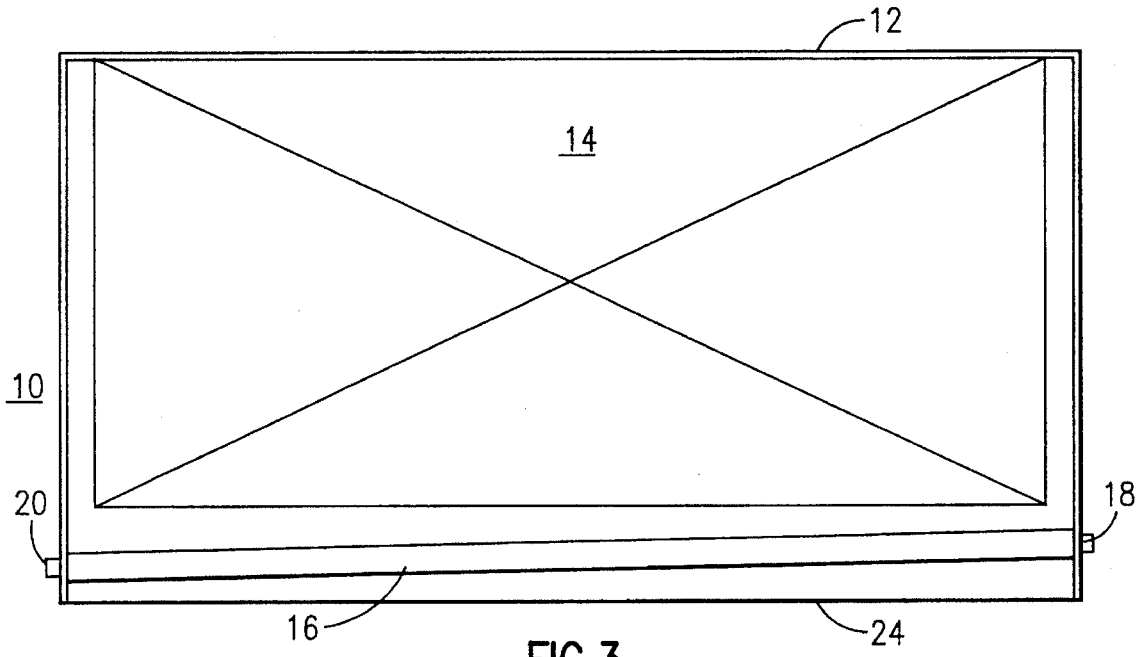
Figure 4:
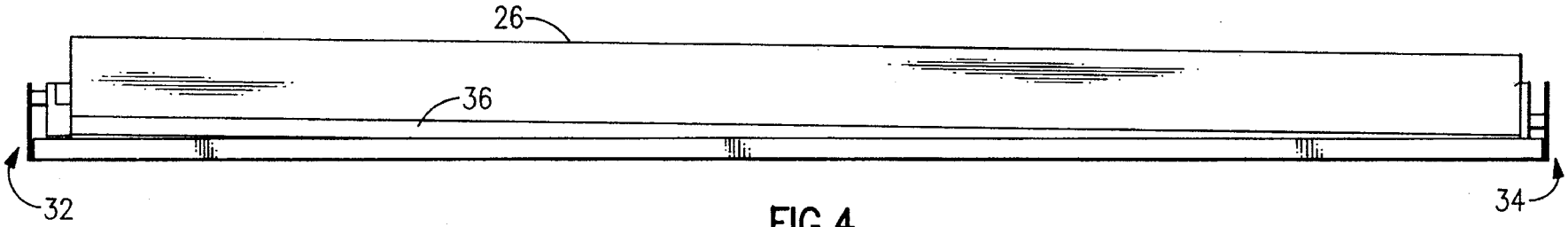
FIG. 4 is a front elevation of the drain pan assembly of this embodiment.

With reference to the Drawing, FIGS. 1, 2, and 3 show a fan coil unit 10 of an air conditioning or heat pump system has a housing or enclosure 12 containing a heat exchanger coil 14, here serving as an evaporator coil. In the case of a combined heat pump and air conditioning system, the heat exchanger coil can be a dual purpose coil, serving alternately as an evaporator and as a condenser coil. While not shown here, the fan coil unit 10 also includes a fan or blower for forcing air to flow over the coil 14, as well as refrigeration connections that couple to the remainder of the air conditioning and/or heat pump system. Beneath the evaporator coil 14 is a condensate drain pan or tray 16, here configured to be self-draining from either end. The drain pan 16 is open along its upper side to receive moisture that condenses onto the coil 14. The pan 16 extends over the length of the coil 14 and is situated immediately below the lower edge thereof.

The drain pan 16 has a drain nipple 18 on its :right end and another drain nipple 20 at its left end. These nipples are short pipe stems than permit connection with piping to a field drain. The drain pan 16 can have its right end lowered for draining through the nipple 18, as shown in FIG. 2; or can have its left end lowered for drainage through the nipple 20, as shown in FIG. 3. In either case the opposite nipple 18 or 20 is left open and serves as an overflow outlet.

As shown in FIGS. 2 and 3, whichever end of the drain pan 16 is selected for drainage, the bottom wall 24 of the cabinet 12 can remain level and flush against a floor or other supporting structure. Thus, this embodiment of the invention permits either left or fight side connection of the drain pan 16 to a convenient field drain, without requiting the fan coil unit to itself to be tilted.

Details of the drain pan of this embodiment of the invention are shown in FIGS. 4, 5, 6, 7, and 8. The drain pan 16 is formed of an elongated tray 26, here extruded of plastic as a channel having an open top, with a one-piece left end cap 28 and a similar one-piece right end cap 30 closing off the left and fight ends of the tray 26. The ripple 20 is integrally formed in the end cap 28 and projects out therefrom, while the other nipple 18 is similarly formed in the other end cap 30.

Figure 6:
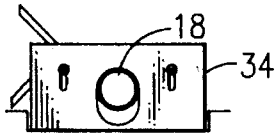
FIGS. 5 and 6 are end elevations showing the left and right mounting flanges or this embodiment.
Figure 5:
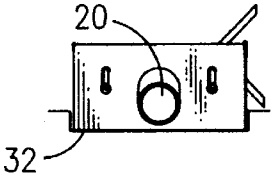
Figure 7:
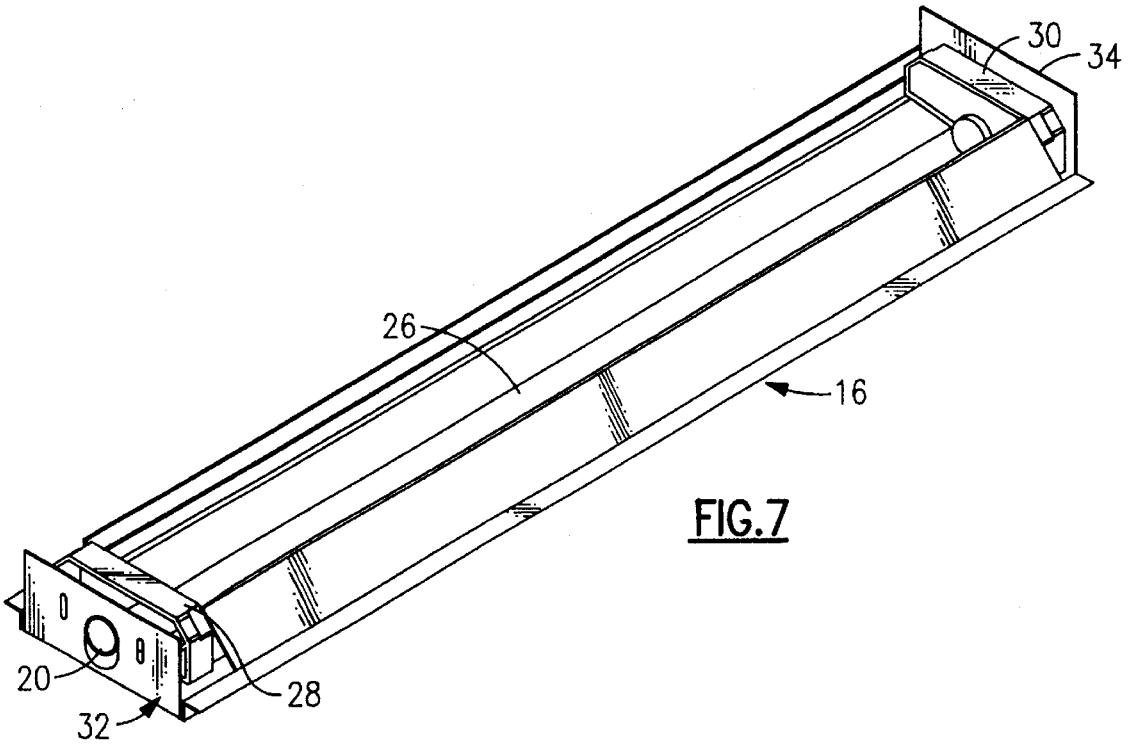
FIG. 7 is a perspective view of the drain pan assembly- of this embodiment.
Figure 8:
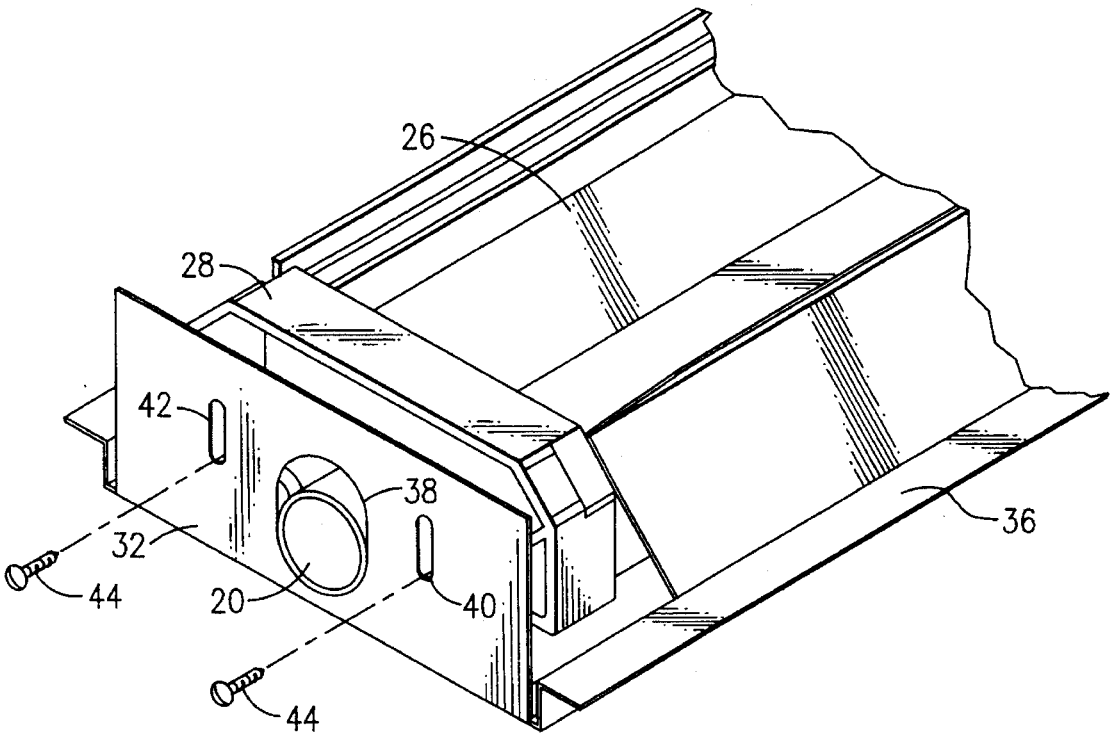
FIG. 8 is an enlarged partial perspective view of one end of the drain pan assembly of this embodiment.

Mounting brackets 32 and 34 are formed as a pan of the drain pan housing to be supported by the cabinet 12 and are disposed directly below the heat exchanger coil 14. The brackets 32, 34 are formed of sheet metal, and in this embodiment are formed on a drain pan housing 36, which is also formed of sheet metal and which contains the tray 26. The left and right mounting brackets 32, 34 are of similar construction, as shown in FIGS. 5 and 6, and the left bracket 32 is shown in detail in FIG. 8.

In the bracket 32, a vertically elongated drain slot or opening 38 permits penetration outward of the associated drain nipple 20, and permits some adjustment or play in the vertical direction between upper and lower limits. On either side of the drain slot 38 there are vertically elongated adjustment slots 40 and 42. Sheet metal screws 44 penetrate these slots 40, 42 and screw into the end cap 28. The screws 44 normally hold the end cap 28 tight against the bracket 32. However, by loosening the screws 44, the end cap 28 can be lowered or raised over the length of these adjustment slots.

The fan coil unit 12 is shipped from the factory with both ends of the condensate drain pan 16 in the raised position. The installer then can simply lower one end or the other, whichever end is more convenient to a field drain, and this is accomplished by loosening and tightening the two screws 44 at that end. The nipple at the other end of the drain pan serves as an emergency overflow outlet.

Figure 9:
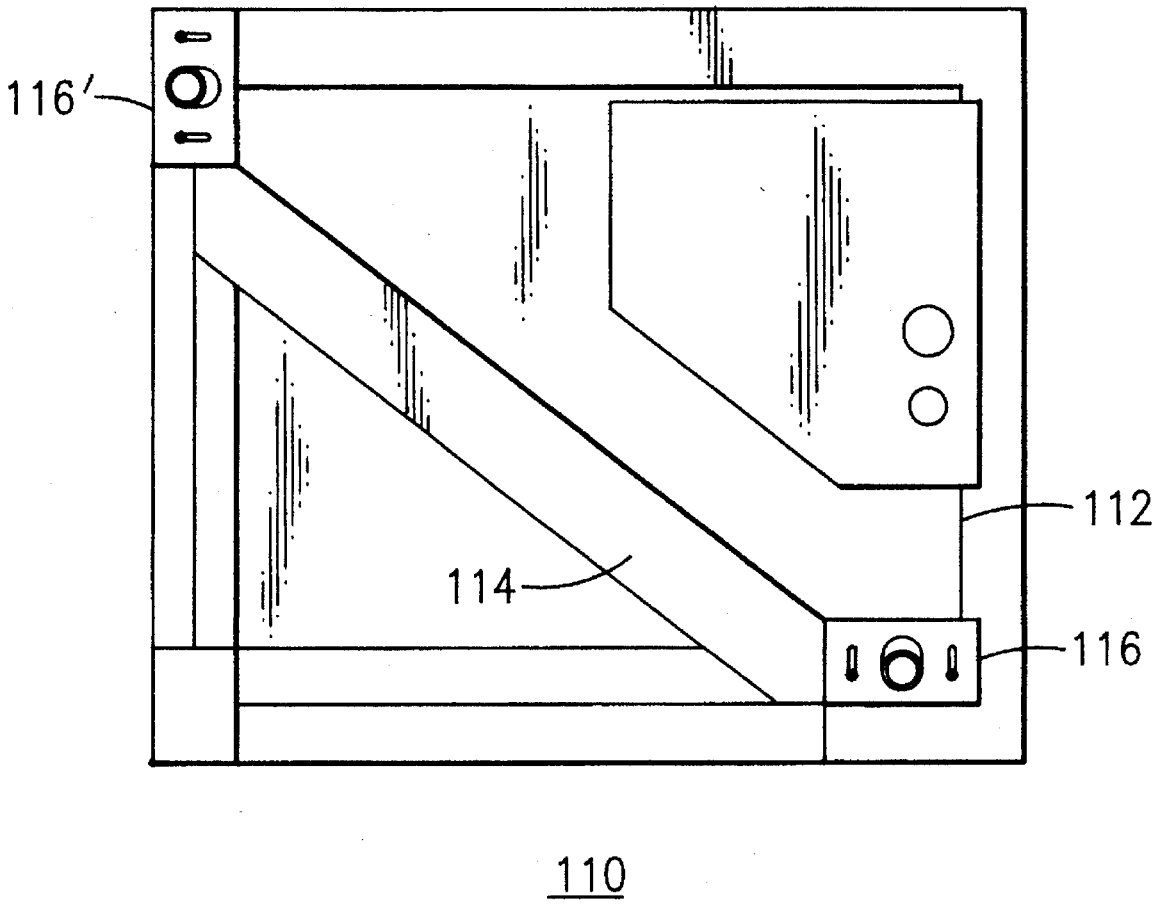
FIG. 9 is a schematic side elevation of an alternative fan coil unit employing the adjustable condensate drain pan of this invention.

An alternative fan coil unit is shown schematically in FIG. 9, in which similar parts to those in the first embodiment are identified with similar reference numbers, but raised by 100. Here the unit 110 has a cabinet 112 containing a heat exchanger coil 114, as in the first embodiment. However, this fan coil unit is constructed for orientation in either a vertical or a horizontal poise, and can be rotated 90 degrees counter-clockwise from the orientation shown. In this construction there is a first drain pan 116 positioned under the lower edge of the coil 114, and a second drain pan 116' positioned left of the upper edge of the coil 114. When the fan coil unit is rotated for installation in the alternate poise, the second drain pan 116' is then positioned beneath the evaporator coil 114. Both the drain pans 116 and 116' are of construction similar to the drain pan 16 as described above.

While this invention has been described in detail with reference to a preferred mode, it is to be understood that the invention is not limited to that embodiment. Rather, many modifications and variations will present themselves to persons skilled in the art without departing from the scope and spirit of the invention as defined in the appended claims.

We claim:

1. Fan coil condensate drain pan for use in a fan coil unit having a cabinet, and in which the drain pan can be pitched for either fight side discharge or left side discharge; comprising:

an elongated trough having an open upper side, right and left end caps closing off ends of said trough, and right and left drain nipples that project through the right and left end caps, respectively;

said trough having right and left mounting brackets to be supported by the cabinet and to which the right and left end caps of said trough are fastened; each said bracket having a vertically elongated drain slot through which the respective drain nipple projects, the slot permitting vertical play of the associated end cap between upper and lower limits; and at least one vertically elongated fastener slot through which a fastener device engages the respective end cap for retaining said end cap at a selected position between said upper and lower limits.

2. Fan coil condensate drain pan according to claim 1 wherein said end caps are each one-piece molded plastic, with said drain nipples being formed intergrally therewith.

3. Fan coil condensate drain pan according to claim 1 wherein said mounting brackets include a pair of vertical fastener slots, one on each side of said vertically elongated drain slot.

4. Fan coil condensate drain pan according to claim 1 wherein said elongated trough is a one-piece element formed of a plastic resin.

5. Fan coil condensate drain pan according to claim 1, wherein said fan coil unit further comprises a heat exchanger coil mounted in said cabinet above said condensate drain pan, said drain pan and said heat exchanger coil being supported in said cabinet independent of one another.

* * * * *